US007230212B1

(12) United States Patent
Sarkisian et al.

(10) Patent No.: US 7,230,212 B1
(45) Date of Patent: Jun. 12, 2007

(54) GOLF BALL HEATER

(75) Inventors: Paul Sarkisian, Boulder City, NV (US); Uwe Rockenfeller, Boulder City, NV (US)

(73) Assignee: Rocky Research, Boulder City, NV (US)

( * ) Notice: Subject to any disclaimer, the term of this patent is extended or adjusted under 35 U.S.C. 154(b) by 0 days.

(21) Appl. No.: 11/477,103

(22) Filed: Jun. 27, 2006

(51) Int. Cl.
*H05B 3/06* (2006.01)

(52) U.S. Cl. ..... 219/521; 219/385; 219/386; 219/535

(58) Field of Classification Search ..... 219/521, 219/392, 386, 524, 385, 527, 525, 430, 439, 219/535
See application file for complete search history.

(56) References Cited

U.S. PATENT DOCUMENTS

| | | | | |
|---|---|---|---|---|
| 1,939,017 | A | 12/1933 | Naeve | |
| 3,497,676 | A | 2/1970 | Gravatt | |
| 3,683,155 | A * | 8/1972 | Loofbourow et al. | 219/521 |
| 3,746,837 | A | 7/1973 | Frey et al. | |
| 3,831,001 | A | 8/1974 | Toomey et al. | |
| 4,049,949 | A | 9/1977 | Fitzsimons | |
| 4,155,002 | A | 5/1979 | Cohen | |
| 4,420,681 | A | 12/1983 | Arnold | |
| 4,967,062 | A | 10/1990 | Cohen | |
| 5,057,670 | A | 10/1991 | Cohen | |
| 5,998,771 | A | 12/1999 | Mariano et al. | |
| 6,130,411 | A * | 10/2000 | Rockenfeller et al. | 219/392 |

FOREIGN PATENT DOCUMENTS

| | | |
|---|---|---|
| JP | 60-124386 | 6/1985 |

* cited by examiner

*Primary Examiner*—Philip H. Leung
*Assistant Examiner*—Leonid Fastovsky
(74) *Attorney, Agent, or Firm*—Knobbe Martens Olson & Bear LLP

(57) ABSTRACT

A golf ball heating appliance for heating 4 or more golf balls to an average temperature of between 40° C. and 55° C. during an active heating period of 30 minutes or less has a lower thermally conductive and an upper non-thermally conductive receptacle for receiving a plurality of golf balls and includes an electrical heating element capable of delivering at least 4 watts of power per ball during the active heating period.

25 Claims, 1 Drawing Sheet

GOLF BALL HEATER

BACKGROUND OF THE INVENTION

It is known that golf balls heated to temperatures between about 30° C. and about 50° C. have improved performance as evidenced by the greater distance a warm or hot ball will travel as compared to a cold ball when hit with the same driving force. A number of prior art heating devices have been proposed to take advantage of the aforesaid performance improving heating effect. Most of the proposed heaters use hot air for heating the balls, for example, as disclosed in U.S. Pat. Nos. 3,683,155, 4,420,681, 4,967,062 and 5,057,670. According to the aforesaid patents the golf balls are intentionally heated relatively slowly to temperatures of up to about 120° F. (48.9° C.) for at least about six hours or longer (U.S. Pat. No. 3,831,001) and up to two days or longer (U.S. Pat. No. 3,683,155) prior to use. For most golfers, such heating times are often impractical. The heated balls must also be maintained at the desired elevated temperatures until they are ready for use, thus requiring continued heating or storing the balls in a well-insulated container.

In our prior U.S. Pat. No. 6,130,411 there is described a golf ball heater appliance utilizing upper and lower receptacles having opposite and facing cavities both receptacles comprising a thermally conductive material capable of heating the golf balls within the cavities.

SUMMARY OF THE INVENTION

The golf ball heating appliance described herein is capable of simultaneously heating a plurality of golf balls to an average temperature of at least about 40° C. in about 30 minutes or less, typically the time it takes for a golfer to drive from home to a golf course. The heating appliance, designed for holding a plurality of balls, heats the balls primarily by conduction from the heated surface of only one semi-spherical cavity contacting the golf ball. The appliance of the invention is also capable of maintaining the temperature of the heated golf ball for at least about 2 hours and preferably for about 4 hours after the power to the heating element is terminated. The appliance is characterized by having one thermally conductive receptacle and one non-thermally conductive ball receptacle. Each receptacle has the same number of semi-spherical cavities. When the receptacles are brought together, each pair of opposite and facing semi-spherical cavities form a spherical cavity for holding one golf ball. The heating appliance includes a resistive heating element cooperating with the thermally conductive receptacle to provide heating of the balls.

DETAILED DESCRIPTION OF THE INVENTION

The golf ball heater is primarily useful in locations where the average ambient daytime temperature is about 30° C. or below, as well as where golf balls cool to below 30° C.

overnight, for example, where stored in a vehicle or garage where cooler nighttime temperatures cause cooling of the balls to below 30° C.

The process of the invention is in heating one or more golf balls to an average ball temperature of at least 40° C., preferably between 40° C. and about 55° C., within 40 minutes or less, preferably 30 minutes or less. The average ball temperature takes into account the temperature of the cover as well as the internal ball temperature, i.e., the mean temperature of the mass of the ball. A first step is an active heating phase during which heat is applied to the exterior surface of the ball using a heater appliance described hereinafter, followed by a second phase in which the temperature of the ball is equilibrated. In the first phase heat is applied to the ball preferably at a level of 4-25 watts per ball, for 40 minutes or less, preferably 30 minutes or less. During the active heating period, a cover or surface ball temperature above 75° C. is to be avoided and preferably does not exceed 65° C. The specific heating time will depend on the amount of energy or wattage applied to each ball, and the temperature of the ball before heating. For example, where the initial average ball temperature is 5° C. and 10 watts per ball energy is applied, an active heating period of 40 minutes could be used, heating the outside cover to about 55° C., followed by an equilibration period of 10 to 15 minutes to achieve an average or equilibrated ball temperature of about 50° C. It will be understood that the above times and temperatures are approximate and balls from different manufacturers will produce slightly different results. A suitable equilibration period is between about 5 and about 30 minutes, and preferably is 15 minutes or less. At complete equilibration, the internal and surface ball temperatures are substantially equal. However, for purposes of the process of the invention, the equilibration step will yield a difference of internal and external (surface) ball temperature of 5° C. or less and a ball surface temperature of less than about 55° C.

Figure 1:
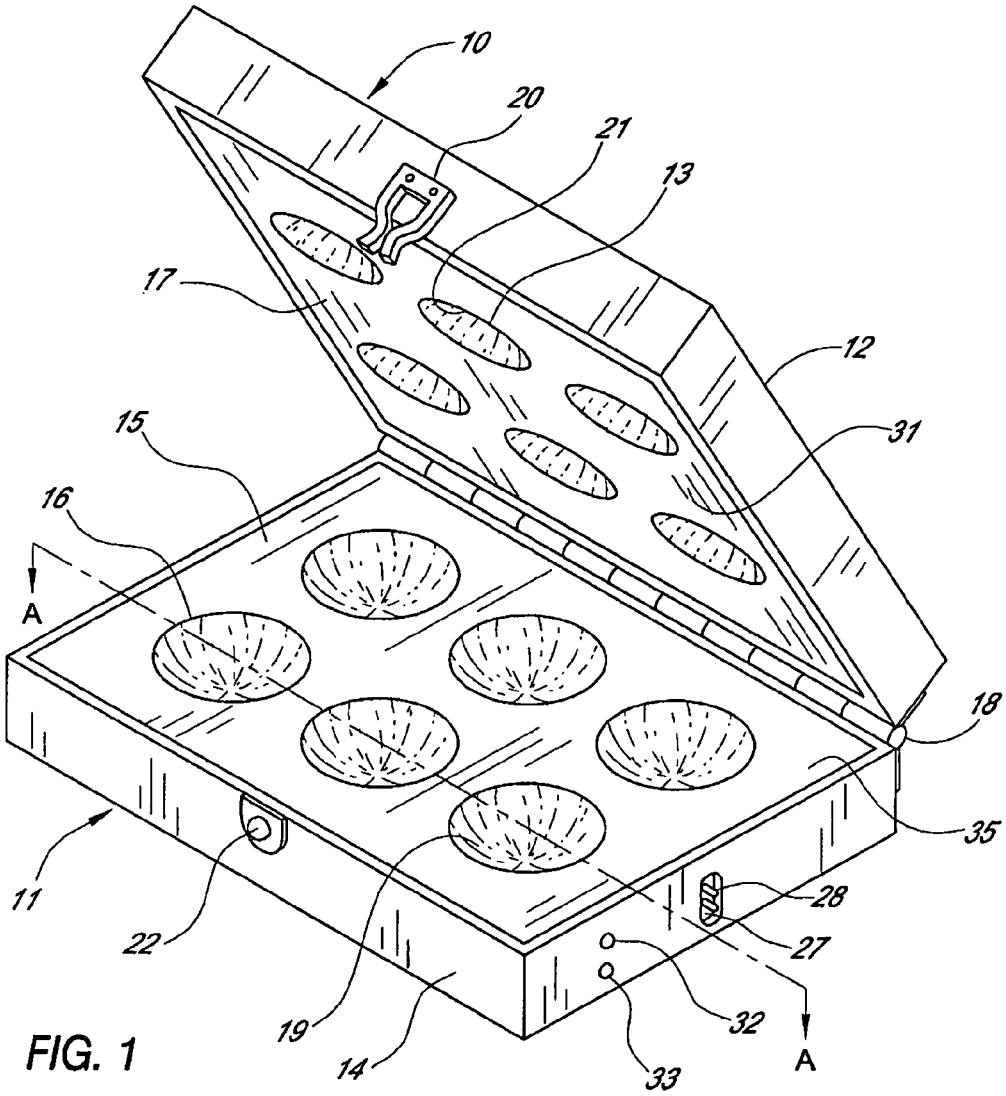
FIG. 1 is a perspective view of the golf ball heater illustrating the interior including the semi-spherical golf ball holding cavities.
Figure 2:
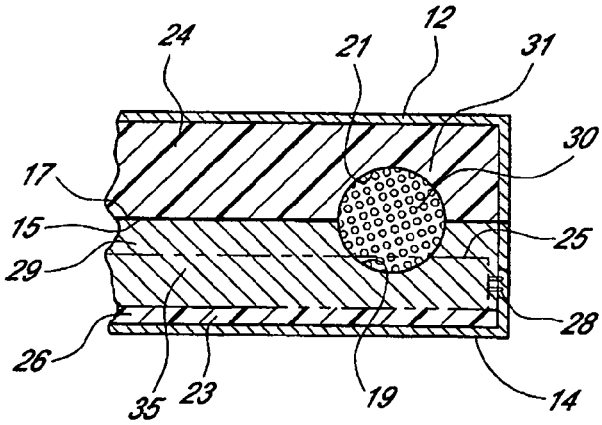
FIG. 2 is a partial sectional view taken along line A-A of FIG. 1 illustrating the golf ball heater in a closed condition showing a golf ball located in one of the spherical cavities.

A preferred embodiment of the golf ball heating appliance illustrated in FIGS. 1 and 2 includes an upper assembly 10 and a lower assembly 11, each comprising a receptacle having a plurality of semi-spherical cavities. The upper assembly 10 includes a lid 12 and an upper receptacle 31 in which are formed a plurality of semi-spherical cavities 13. The lower assembly 11 includes a base 14 in which a lower receptacle 35, also having a plurality of semi-spherical cavities 16, is secured. In the preferred embodiment shown, the lower receptacle comprises thermally conductive material 29 and the upper receptacle comprises substantially non-thermally conductive material 24.

Referring also to FIG. 2, each of the semi-circular cavities are sized or dimensioned to be slightly oversized from one-half of the spherical surface of a golf ball. When the appliance is closed, the facing surfaces 17 and 15 of the upper and lower receptacles 31 and 35 are in substantial contact and opposite and facing semi-spherical cavities form a spherical chamber in which a golf ball is held. The slightly oversized cavities provide for contact of a major amount of the golf ball surface with the interior surface of the upper and lower semi-spherical cavities. Such a feature is illustrated in FIG. 2 in which a golf ball 30 shown is in substantial physical contact with the interior surfaces 19 and 21 of the respective lower and upper cavities. Substantial golf ball surface contact with the thermally conductive semi-spherical lower cavity ensures more efficient and rapid heating by conduction as compared to conventional heating devices which use hot air as the primary means for heating the surface of the ball.

The thermally conductive receptacle 35 comprises a thermally conductive material 29, such as aluminum or copper or other metals or metal alloys or carbon or graphite composites which efficiently conduct heat from a heating element, preferably a resistive heating element. The conductive receptacle will efficiently and rapidly heat the golf balls in the active heating stage to the desired average temperature of at least about 40° C. up to about 55° C. within a relatively short period of time of about 40 minutes or less, but without heating the surface of the ball above 75° C. and preferably does not exceed 65° C. to avoid thermal degradation, deformation or damage to the outer surface of the ball. The thermally conductive receptacle may be made of a block or thick portion of aluminum, copper or other efficient heat conducting metal as illustrated in FIG. 2. Alternatively, the receptacle may be formed of a sheet of aluminum, copper or other heat conductive metal with lower insulation insert 26, between the housing member and the thermally conductive receptacle. Combinations of different metals may also be used in forming the thermally conductive receptacle. Another material having excellent thermal conduction comprises a carbon or graphite foam composition. Because carbon foam has substantially reduced density as compared to aluminum or copper the use of such a material may be preferred where high thermal conductivity and weight reduction is desired. The highly thermal conductive foam may be also used in a laminate or sandwich structure for improving mechanical properties. A specific material of this type is described as foam core sandwich panel made from thermal conductive mesophase pitch-based carbon foam developed by Oak Ridge National Laboratory, Oak Ridge, Tenn. Such a panel comprises a laminate in which the carbon foam is sandwiched between outer layers of aluminum or copper secured to the foam with an adhesive.

In the preferred embodiment shown, the upper non-thermally conductive receptacle 31 comprises an insulative material 24 in which the upper semi-spherical cavities 13 are formed. Preferred non-thermally conductive materials include plastics, for example, polypropylene, polyurethane, ABS resins, polyisocyanurate, and any other substantially non-thermally conductive materials, as understood by those skilled in the art. The non-thermally conductive material may be an entire block of the insulative plastic in which the semi-spherical cavities are formed, or it may be a panel of the non-thermally conductive material with the semi-spherical cavities formed in the panel, with air or preferably a vacuum between the panel and the lid. Alternatively, a combination of a different substantially non-thermally conductive materials may be used, such as layered, or sandwiched, and again, a portion of the space within the upper housing member may be evacuated thereby further improving the insulative quality of the upper housing assembly. The lid 12 may be formed separately and of a different material from the upper receptacle 31, or they may be combined in the form of a unitary insulative composition structure.

The lower housing assembly is also sufficiently insulative so as to adequately maintain the temperature of the heated balls for at least about 2 hours after the power to the heating element is terminated. The appliance of the invention is preferably capable of maintaining balls that are heated and equilibrated to about 50° C. for about 4 hours above about 25° C. after power to the heating element is terminated. For such insulation, a layer of insulative material 23 may be provided between the thermally conductive material 29 of the lower receptacle and the case or base 14. The material of the lower case or base may also be insulative and may be formed separately from the lower insulative layer 23, or they may be formed as a single insulative component. The specific insulating material to achieve such an insulation factor combined with the insulation factor of the material of which the housing members are formed may be selected by those skilled in the art. The rate of temperature loss of the golf balls may also be reduced by incorporating a high heat capacity or phase-change material or materials within the apparatus, such as in the upper and/or lower housing member. Suitable materials include water as well as hydrated salts and eutectic salts or other phase-change materials known to those skilled in the art. Most preferred phase-change materials are those having phase-change in the temperature range of 25° C. to 75° C.

A single heating element or multiple heating elements may be used to heat the balls. An example of such a heating element is a positive temperature coefficient heater, or other resistance type heating elements. The one or more heating elements must be in sufficient contact with the thermally conductive receptacle material 35 in the lower housing member to efficiently and adequately direct the heat to the golf balls present in the spherical cavities. As illustrated in FIG. 2, a heating element 25 shown in phantom is provided with plugs 28 for receiving a power cord inserted into the electric receptacle 27 from a power supply source, for example, a 110-120 volt AC power supply. Alternatively, power may be supplied to the heating element from a DC power source, such as a 6 or 12 volt battery or a battery pack or the like. The power supply and heating element used in the heater of the invention are capable of delivering about 4 to 25 watts of energy to each of a plurality of golf balls. The greater the power supply capability of the device, the faster the balls can be heated. A preferred appliance shown holds 6 balls and has a heating capacity of about 80 watts. As previously noted, the appliance of the invention is capable of producing a plurality of balls having the desired average temperature of at least about 40° C. and preferably up to 55° C. within about 30 minutes from the time the power is initially supplied to the ambient temperature balls and without overheating the surface of the balls. Of course, the lower the ambient or initial ball temperature, the greater the length of time required for heating the balls to the desired average temperature range. The preferred appliance of the invention is capable of delivering at least about 4.5 Btu/hr $in^2$, and more preferably 5.3 Btu/hr $in^2$ up to about 18.0 Btu/hr $in^2$ of golf ball surface. The capability of the heating apparatus to heat a ball from ambient of less than 30° C., and usually 20° C. or less, is responsive to the average or typical time it takes to drive a vehicle to a golf course or driving range. With such a heating capability, the heating appliance may be conveniently powered from the cigarette lighter outlet of the automobile for 30 minutes or less during the drive to the golf course. Again, the active heating phase during which the internal ball temperature is elevated from below about 30° C. to the aforesaid range also avoids heating the ball surface at temperatures above 75° C.

Other preferred features of the appliance of the invention include a temperature sensor and power supply cutoff cooperating with the one or more heating elements which components will prevent overheating of the golf balls. Preferably, such components will prevent the golf balls from being heated above an average temperature of about 55° C. (131° F.) and/or a surface temperature of above 70° C., at which temperature or temperatures the power is automatically terminated. These cutoff and temperature sensing components may also allow the power to be turned on or resumed when the golf balls cool to a certain temperature, for example, at 45° C., at which temperature power to the heating element will be supplied. Thus, some maintenance heating may be provided after the initial or active heating period of 30 minutes or less, but only for maintaining internal ball temperatures within the desired range until the ball is ready for play. Other preferred components include a visible light 32 which is illuminated when power is supplied to the heating element, indicating to an observer that the golf balls have not yet reached a preset or maximum temperature and are still being heated. A stand-by light 33 may also optionally be installed for being illuminated when the golf balls have been heated to the desired temperature and may be set to remain illuminated so long as the golf balls are at or above the minimum temperature of 40° C. Such lights or other equivalent visible means for indicating the supply of power and temperature condition of the golf balls may be electrically connected to the controller such as a thermister, thermometer, or equivalent temperature sensing component capable of sensing the temperature of the surface of the golf balls present in the appliance. Of course, such a temperature sensing device need not be present or installed in each of the golf ball holding cavities since heating will be substantially uniform throughout the apparatus along the surface of the respective upper and lower receptacles as long as the appliance remains closed. Selection, positioning and number of thermisters or other temperature sensing devices will be understood by those skilled in the art. Also illustrated in FIG. 1 are upper and lower latch members 20 and 22, respectively, preferably capable of mating engagement for selectively locking and unlocking the upper and lower assemblies between an open condition and fully closed condition as previously described. A hinge 18 allows the appliance to be conveniently opened and closed. Clamps or latches for securing the upper and lower components may also be used.

What is claimed is:

1. A golf heating appliance comprising a thermally conductive receptacle and a non-thermally conductive receptacle, each receptacle having the same number of a plurality of semi-spherical cavities each cavity for receiving one of a plurality of golf balls, one of said receptacles comprising a thermally conductive material capable of delivering at least about 4.5 Btu/hr in$^2$ to a golf ball in each of said cavities and the other of said receptacles comprising a substantially non-thermally conductive material, wherein said cavities in said thermally conductive receptacle are opposite and facing said cavities in said non-thermally conductive receptacle, and wherein each of said semi-spherical cavities are dimensioned to make physical contact with at least a portion of the exterior surface of a golf ball, and wherein said opposite and facing cavities form a spherical cavity making contact with a major amount of the golf ball surface therein and wherein the facing surfaces of the upper and lower receptacles are in substantial contact when said apparatus is closed, and one or more resistive heater elements in thermal contact with only the thermally conductive receptacle, said heater element having a capability of supplying between about 4 watts and about 25 watts per golf ball, and wherein said one or more heater elements and said receptacle are capable of heating said plurality of golf balls from ambient temperature of about 30° C. or less to an average temperature of between about 40° C. and about 55° C. in 30 minutes or less.

2. A golf ball heating appliance of claim 1 wherein said thermally conductive receptacle is a lower receptacle and said non-thermally conductive receptacle is an upper receptacle.

3. A golf ball heating appliance of claim 2 wherein said lower receptacle comprises a block of thermally conductive material having said semi-spherical cavities formed therein and in thermal contact with said one or more resistive heater elements and non-thermally conductive exterior base supporting said block of thermally conductive material.

4. A golf ball heating appliance of claim 3 wherein said upper receptacle comprises a block of non-thermally conductive material having said semi-spherical cavities formed therein.

5. A golf ball heating appliance of claim 3 wherein said lower receptacle includes a thermally insulating composition layer between said housing member base and said block of thermally conductive material.

6. A golf ball heating appliance of claim 4 wherein said lower receptacle includes a thermally insulating composition layer between said housing member base and said block of thermally conductive material.

7. A golf ball heating appliance of claim 5 wherein said thermally insulative composition is solid.

8. A golf ball heating appliance of claim 5 wherein said thermally insulative composition is liquid.

9. A golf ball heating appliance of claim 5 wherein said thermally insulative composition is gaseous.

10. A golf ball heating appliance of claim 4 wherein said upper receptacle includes an exterior lid covering said block of non-thermally conductive material.

11. A golf ball heating appliance of claim 10 wherein said upper receptacle includes a layer of thermally insulative composition between said block of non-thermally conductive material and said exterior lid.

12. A golf ball heating appliance of claim 11 wherein said thermally insulative composition is solid.

13. A golf ball heating appliance of claim 11 wherein said thermally insulative composition is liquid.

14. A golf ball heating appliance of claim 11 wherein said thermally insulative composition is gaseous.

15. A golf ball heating appliance of claim 1 wherein said upper and lower housing members include a thermally insulative material capable of maintaining the average temperature of balls heated therein to between about 40° C. and about 55° C. at an average temperature of at least about 25° C. for about 4 hours after power to said one or more resistive heating elements is terminated.

16. A golf ball heating appliance of claim 15 wherein said one or more heater elements are capable of supplying between about 4 watts and about 25 watts per golf ball.

17. A golf ball heating appliance of claim 1 comprising at least four of said ball receiving cavities.

18. A golf ball heating appliance of claim 1 including an adapter cooperating with said one or more resistive heater elements for supplying power thereto from a DC power source.

19. A golf ball heating appliance of claim 1 including an adapter cooperating with said one or more resistive heater elements for supplying power thereto from a 110-120V AC power source.

20. A golf ball heating appliance of claim 1 including temperature sensor and power supply cutoff cooperating with said one or more heater elements for preventing heating thereof above about 55° C.

21. A golf ball heating appliance of claim 1 wherein said lower receptacle comprises a sheet of said thermally conductive material and a lower housing member, and insulation between said lower receptacle and said lower housing member, and said upper receptacle comprises a substantially non-thermally conductive material, and wherein said upper and lower receptacles when closed are capable of maintaining the temperature of golf ball therein heated to between about 40° C. and about 55° C. at a temperature of at least about 25° C. for about 2 hours after power to said one or more resistive heater elements is terminated.

22. A golf ball heating appliance of claim 1 wherein said thermally conductive material comprises carbon or graphite foam.

23. A golf ball heating appliance of claim 1 wherein said thermally conductive material is mesophase pitch-based carbon foam.

24. A golf ball heating appliance of claim 1 wherein said thermally conductive material comprises a carbon foam laminated between sheets of aluminum or copper.

25. A golf ball heating appliance of claim 1 wherein said thermally conductive material comprises aluminum or copper.

* * * * *

UNITED STATES PATENT AND TRADEMARK OFFICE

CERTIFICATE OF CORRECTION

PATENT NO. : 7,230,212 B1
APPLICATION NO. : 11/477103
DATED : June 12, 2007
INVENTOR(S) : Sarkisian et al.

It is certified that error appears in the above-identified patent and that said Letters Patent is hereby corrected as shown below:

On The Title page Item (56) (Foreign Patent Documents), line 1, After "JP 60-124386" delete "6/1985" and insert -- 7/1985 --, therefor.

On Sheet 1 of 1, (FIG. 1), line 1, above "FIG.1" insert -- 1 of 1 --.

Signed and Sealed this

Twentieth Day of November, 2007

JON W. DUDAS
*Director of the United States Patent and Trademark Office*